US006446475B1

(12) United States Patent
Agnatovech et al.

(10) Patent No.: US 6,446,475 B1
(45) Date of Patent: Sep. 10, 2002

(54) SWITCHLOCK ASSEMBLY WITH SNAP-IN CAM

(75) Inventors: William Joseph Agnatovech, Hudson, MA (US); Robert Ehrensberger, Imperial, PA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/878,636

(22) Filed: Jun. 11, 2001

Related U.S. Application Data

(60) Provisional application No. 60/211,009, filed on Jun. 12, 2000.

(51) Int. Cl.[7] ..... E05B 17/04

(52) U.S. Cl. ..... 70/379 R; 70/252; 70/380; 70/466; 70/DIG. 30

(58) Field of Search ..... 70/252, 379 R, 70/379 A, 380, 421, DIG. 30, 372, 466; 200/43.08

(56) References Cited

U.S. PATENT DOCUMENTS

| | | | | | |
|---|---|---|---|---|---|
| 2,257,741 | A | * | 10/1941 | Gray | 70/379 R |
| 2,278,044 | A | * | 3/1942 | Scanlan | 70/379 R |
| 2,962,888 | A | * | 12/1960 | Ahlquist | 70/379 R |
| 3,936,673 | A | * | 2/1976 | Kelly et al. | 200/43.08 X |
| 4,558,193 | A | * | 12/1985 | Test | 200/43.08 |
| 4,829,798 | A | * | 5/1989 | Roop | 70/379 R |
| 4,890,467 | A | * | 1/1990 | Krause et al. | 200/43.08 X |
| 4,956,983 | A | * | 9/1990 | Okamura et al. | 70/257 X |
| 5,235,832 | A | * | 8/1993 | Lux et al. | 70/375 X |
| 5,479,800 | A | * | 1/1996 | Myers | 70/365 |
| 5,640,864 | A | * | 6/1997 | Miyamoto | 70/380 X |

FOREIGN PATENT DOCUMENTS

| | | | | |
|---|---|---|---|---|
| DE | 2802408 | * | 7/1979 | 70/373 |
| GB | 436968 | * | 4/1937 | 200/43.08 |

* cited by examiner

*Primary Examiner*—Lloyd A. Gall
(74) *Attorney, Agent, or Firm*—Pearson & Pearson, LLP

(57) ABSTRACT

A switchlock assembly with snap-in cam for mounting in a panel from the front with the panel cutout being smaller than the cam radius. The switchlock assembly comprises a switch base, a shell, a plug operable by a key, the cam and a latch clip. The latch clip prevents the plug from being removed from the shell. The latch clip also secures the cam within the plug and prevents the cam from being removed, but does not prevent the cam from rotating when a key is inserted into the plug of the switchlock assembly and turned. Switch tumblers and tumbler splines enable a key to be pulled out in a designated position, but not to allow the key to be pulled out 180 degrees from the designated key pull position.

23 Claims, 11 Drawing Sheets

SWITCHLOCK ASSEMBLY WITH SNAP-IN CAM

This is a nonprovisional patent application claiming priority of provisional application for patent Ser. No. 60/211,009, filed Jun. 12, 2000.

BACKGROUND OF THE INVENTION

1. Field of the Invention

This invention relates generally to switchlocks and in particular to a switchlock assembly having a snap-in cam and a latch clip allowing the switchlock assembly to be mounted into a panel cutout smaller than what would be required if the cam was attached to the switchlock assembly prior to mounting in the panel.

2. Description of Related Art

Cam locks are well known in the art and have a wide variety of uses ranging from pay telephones, automatic bank tellers, data processing equipment, parking meters, gas pump meters, burglar alarm controllers, gun racks, and the like.

It is also known in the art to have a combination lock/cam lock design which has a dress nut on the front of the assembly and the assembly is mounted from the rear of the panel. Such a switch is sold by ITT Canon, C & K Components, Inc. of Watertown, Mass., the assignee of the present invention. However, when such a switch is mounted from the rear of the panel, the lock can be easily defeated by a wrongdoer removing the dress nut and removing the lock from the panel.

U.S. Pat. No. 4,829,798, entitled "Combination Switch Lock/Cam Lock Assembly" issued May 16, 1989 to Stevie C. Roop and assigned to Medeco Security Locks, Inc., of Salem, Vt., discloses a high security combination lock/cam lock assembly which is resistant to defect and does not have a dress nut which can be unthreaded to defeat the lock. The combination lock comprises a one-piece shell, a plug with a tenon, an electrical switch, and a cam which is insertable from the front face of a panel opening by not affixing the cam until after the lock is inserted in the panel. However, the present invention engages the plug directly with the snap-in cam whereas in the prior art the retainer engages with the plug. Also, the latch clip in the present invention locates the shell on the plug in an axial direction but allows rotation of the plug in the shell. The prior art relied on a retaining ring for this axial retention.

U.S. Pat. No. 2,257,741, entitled "LOCK", issued Oct. 7, 1941 to R. L. Gray and assigned to Illinois Lock Company discloses a lock operated by a key useful for a desk draw comprising a barrel adapted for fixed attachment to another structure and provided with a plug rotatable in response to operation of a key, a guideway substantially opposite a keeper, a bolt movable to engage or disengage the keeper and provided with a shank and compression spring actuated to extend eccentrically from the plug end in sliding engagement with the shank adapted to establish a pivotal locking connection between the plug and the bolt. However, this design requires the use of a compression spring.

U.S. Pat. No. 2,278,044, entitled "LOCK", issued Mar. 31, 1942 to R. A. Scanlan and assigned to American Hardware Corporation discloses a key operated lock that is simple in construction and efficient in operating. It is used with metal office furniture. The lock comprises a cylinder with a plug rotatably mounted in the cylinder and has a key slot for a key. In the operation of assembling the device the cylinder is secured in place by means of a nut. The bolt is then inserted through the hole in the upper edge of the drawer and into the opening through the cylinder the detent having an inclined edge which coming in contact with the opening in the cylinder, will cause the detent to be depressed against the tension of the spring and therefore permit the bolt to be inserted until shoulders on the bolt come in contact with the edges of the openings through the cylinder. In this operation of inserting the bolt, the actuating pin should be turned by means of a key. When the bolt is fully inserted the detent will snap into its locking position. A retainer in an annular groove in the wall of the bore retains the key plug in the cylinder. However, this switch design is expensive to produce.

U.S. Pat. No. 2,962,888 entitled "LOCK", issued to R. W. Ahlquist, and assigned to American Hardware Corporation discloses a key operated cylinder lock of the type commonly used on desk draws and other closures for locking them in a closed position. The lock comprises a cylinder, a bolt and a spring member which permits the bolt to be assembled to the lock cylinder without removing the key plug. However, this switch requires the use of a retaining bar for the spring.

U.S. Pat. No. 5,479,800 entitled "PLASTIC LOCK", issued Jan. 2, 1996 to G. L. Myers, and assigned to Fort Lock Corporation discloses a key lock mechanism which can be made entirely of molded plastic parts comprising a lock shell that can be snap fit in a mounting opening wherein the shell is predominantly a cylindrical casing, and a lock plug within and rotatable about the longitudinally axis of the shell. The rear end of the plug receives a snap on actuation means such as a cam with a securing ramp which snaps into a securing notch. However, this lock design uses a plastic bolt not having the strength of a metal bolt.

SUMMARY OF THE INVENTION

Accordingly, it is therefore an object of this invention to provide a switchlock assembly with a snap-in cam and a latch clip to allow the switchlock assembly to be mounted into a panel cutout smaller than what would be required if the cam was part of the switchlock assembly prior to mounting of the switchlock assembly in the panel.

It is another object of this invention to provide a switchlock assembly that allows a key to be pulled out in a designated position, but not to allow the key to be pulled out 180 degrees from the designated key pull position, even though a plug of the switchlock assembly can be rotated into either position.

It is a further object of this invention to provide a switchlock assembly that mounts to a panel from the front of the panel and is secured by a spring clip prior to insertion of a snap-in cam.

These and other objects are accomplished by a switchlock assembly for mounting in a panel comprising a cylindrical shell having a circumferential opening in a side of the shell, a lock plug positioned within the cylindrical shell having a keyway entering at a first end and a switch driver extending axially from a second end of the lock plug, a switch base mounted on an end of the shell having an opening for receiving the switch driver from the second end of the lock plug, a latch clip inserted within the circumferential opening of the shell and into a clip slot on a side of the lock plug for securing the latch clip within the lock plug, and a cam, having a first portion inserted into the circumferential opening in the side of the shell, snaps into the lock plug adjacent to the latch clip, a second portion of the cam extending outside the diameter of the switchlock assembly, the cam freely rotating with the plug. The lock plug rotates in accordance with a turning of a key inserted into the keyway, thereby rotating the cam. The cylindrical shell comprises a flanged head at an outer end, the flange being recessed to receive a head portion of the plug whereby a base of the plug is flush with a face of the shell. The lock plug comprises a plurality of tumbler slots for receiving a plurality of tumblers operated by the key inserted in the keyway. The clip slot in the side of the cylindrical plug comprises means for securing a retention tab of the latch clip to prevent removal of the latch clip from the plug. The latch clip inserted in the switchlock assembly extends outwardly to at least the outside diameter of the shell thereby preventing the plug from being removed from the shell. The first portion of the cam comprises a slot for receiving a cam retention tab of the adjacent latch clip thereby preventing the cam from being removed from the switchlock assembly. The latch clip comprises a first retention tab extending at an acute angle in a first direction and a second retention tab extending at an acute angle in a second direction opposite the first direction, the first retention tab snapping into an internal surface of the plug for securing the latch clip within the plug. The latch clip retains the lock plug within the shell and the latch clip retains the cam within the lock plug.

The objects are further accomplished by a switchlock assembly adapted for mounting through an opening in a panel from outside the panel comprising a plug having a key slot in a first end for receiving a key, a switch driver plug extending from a second end and a plurality of tumbler slots arranged on a cylindrical wall of the plug having a tumbler inserted in each of the slots, a shell having a cylindrical bore extending therethrough for receiving the plug, the shell having a slot around a portion of the circumference of the shell, a switch base attached to an end of the shell and operated by turning the plug with the key, a latch clip having a first retention tab extending at an acute angle in a first direction and a second retention tab extending at an acute angle in a second opposite direction, the latch clip being inserted through the circumferential slot of the shell and into a latch clip slot on the side of the plug, the first retention tab snapping into an internal surface of the plug thereby securing the latch clip within the plug, and a cam having a latch portion extending through the circumferential slot in the side of the shell into the plug adjacent to the latch clip, wherein the second retention tab of the latch clip snaps into a slot of the latch portion of the cam, thereby securing the cam inside the plug. The switchlock assembly comprises means for enabling the shell to be mounted in the panel opening. The switch base comprises an actuator slot for receiving the switch driver plug extending from the plug. The shell comprises an outer end having a head with a flange and a cylindrical recess for accommodating a head of the plug wherein a face of the plug is flush with a face of the shell. The tumblers and tumbler splines control the removal of the key from a designated position. The latch clip comprises a retention tab extending beyond the diameter of the plug and the inside diameter of the shell to prevent the plug from being removed from the shell. The latch clip retains the plug within the shell and the latch clip retains the cam within the plug.

The objects are further accomplished by a method of providing a switchlock assembly having a snap-in cam comprising the steps of providing a cylindrical shell having a circumferential opening in a side of the shell, positioning a lock plug within the cylindrical shell, the lock plug having a keyway entering at a first end and a switch driver extending axially at a second end of the lock plug, mounting a switch base on an end of the shell having an opening for receiving the switch driver extending axially from the second end of the lock plug, inserting a latch clip into the circumferential opening of the shell and into a clip slot on a side of the lock plug to secure the latch clip within the lock plug, and inserting a first portion of a cam into the circumferential opening in the side of the shell and into the lock plug, the cam snapping into the lock plug, and a second portion of the cam extending outside the diameter of the switchlock assembly. The method comprises the step of inserting a key into the keyway of the lock plug for rotating the cam. The step of inserting a key into the keyway comprises the step of providing a plurality of tumblers within the lock plug operated by the key. The step of inserting the latch clip into the circumferential opening of the shell and into a clip slot on a side of the lock plug comprises the step of extending an end of the latch clip to at least the outside diameter of the shell thereby preventing the plug from being removed from the shell. The step of inserting the latch clip comprises the step of extending a first retention tab of the latch clip at an acute angle in a first direction and extending a second retention tab of the latch clip at an acute angle in a second direction opposite the first direction, whereby the first retention tab snaps against an internal surface of the plug securing the latch clip within the lock plug. The step of inserting the latch clip into the circumferential opening in the side of the shell and into the lock plug comprises the step of snapping the second retention tab of the latch clip into a slot of the cam for retaining the cam within the switchlock assembly. The step of inserting the latch clip into the plug provides for retaining the plug within the shell and retaining the cam within the plug.

Additional objects, features and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
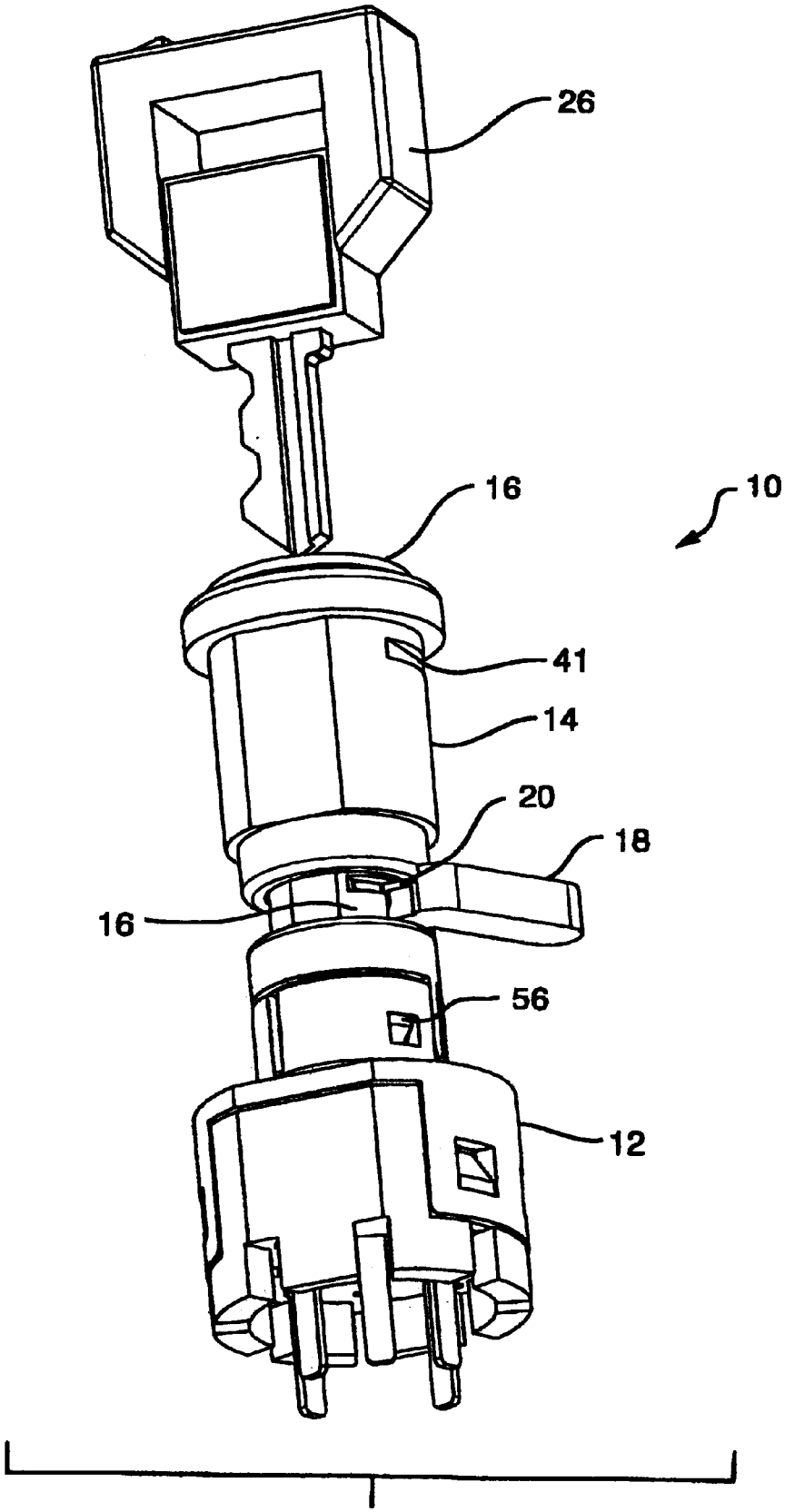
FIG. 1 is a perspective view of the invention of a switchlock assembly with a snap-in cam extending from a side of the switchlock assembly and a key for rotating the cam.
Figure 2:
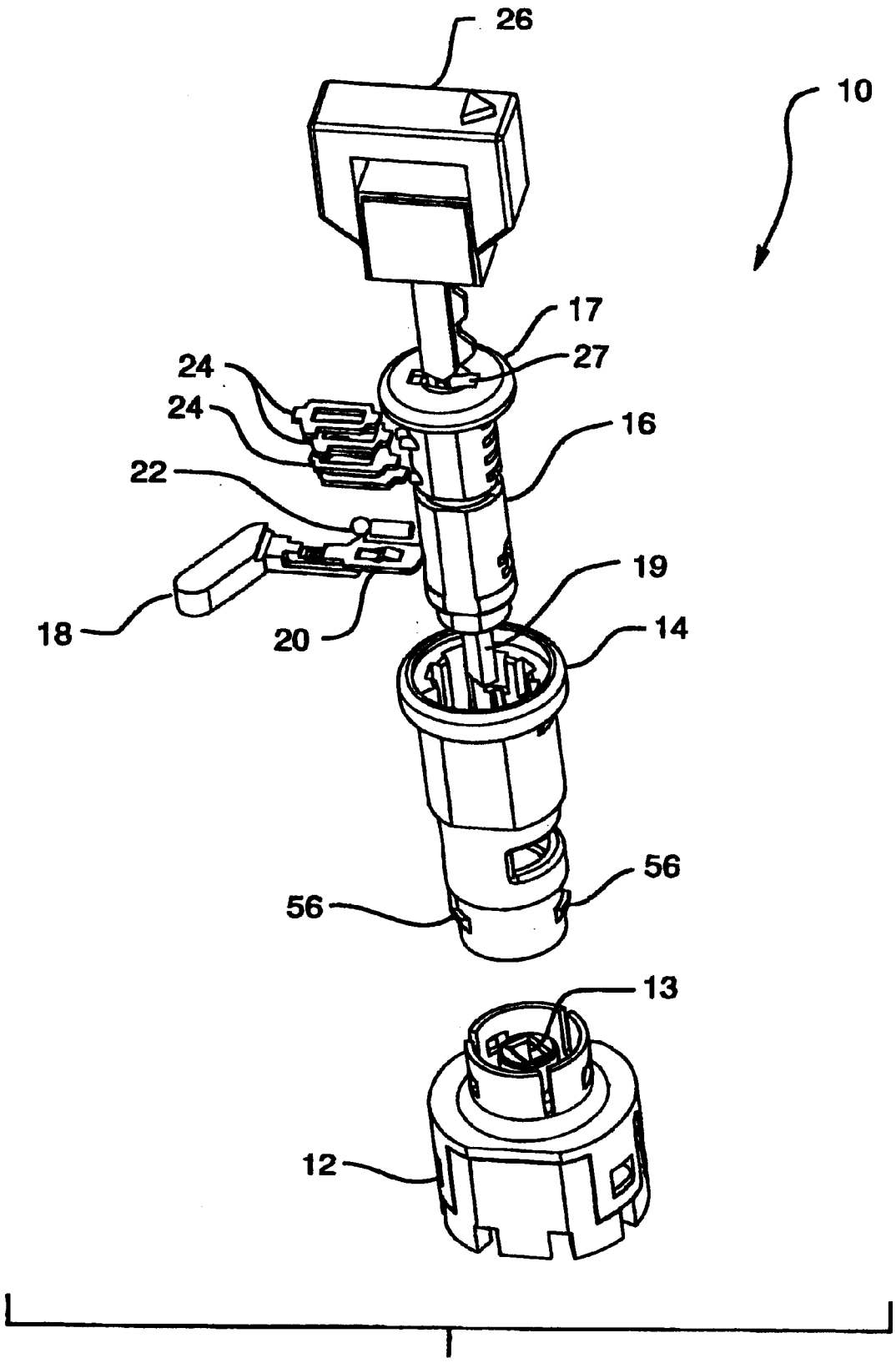
FIG. 2 is an exploded view of the invention of the switchlock assembly with snap-in cam of FIG. 1.

Referring to FIG. 1 and FIG. 2, FIG. 1 is a perspective view of the invention of a switchlock assembly 10 with a snap-in cam 18 extending from a side and a key 26 for rotating the cam 18. FIG. 2 is an exploded perspective view of the switchlock assembly 10. The switchlock assembly 10 allows the key 26 to be pulled in a designated position, but does not allow the key 26 to be pulled 180 degrees from the designated key pull position, even though a plug 16 of the switchlock assembly 10, which receives the key 26, can be rotated into either position. The switchlock assembly 10 can be mounted into a panel cutout (not shown) smaller than what would be required if the cam was attached to the switchlock assembly 10 prior to being mounted in the panel. The switchlock assembly 10 is secured to the panel by a commonly known spring clip (not shown). The switchlock assembly 10 comprises a switch base 12, a shell 14, the plug 16 operable by the key 26, tumbler springs 23*a*–23*d*, tumblers 24*a*–24*d*, the cam 18, and a latch clip 20.

Figure 5:
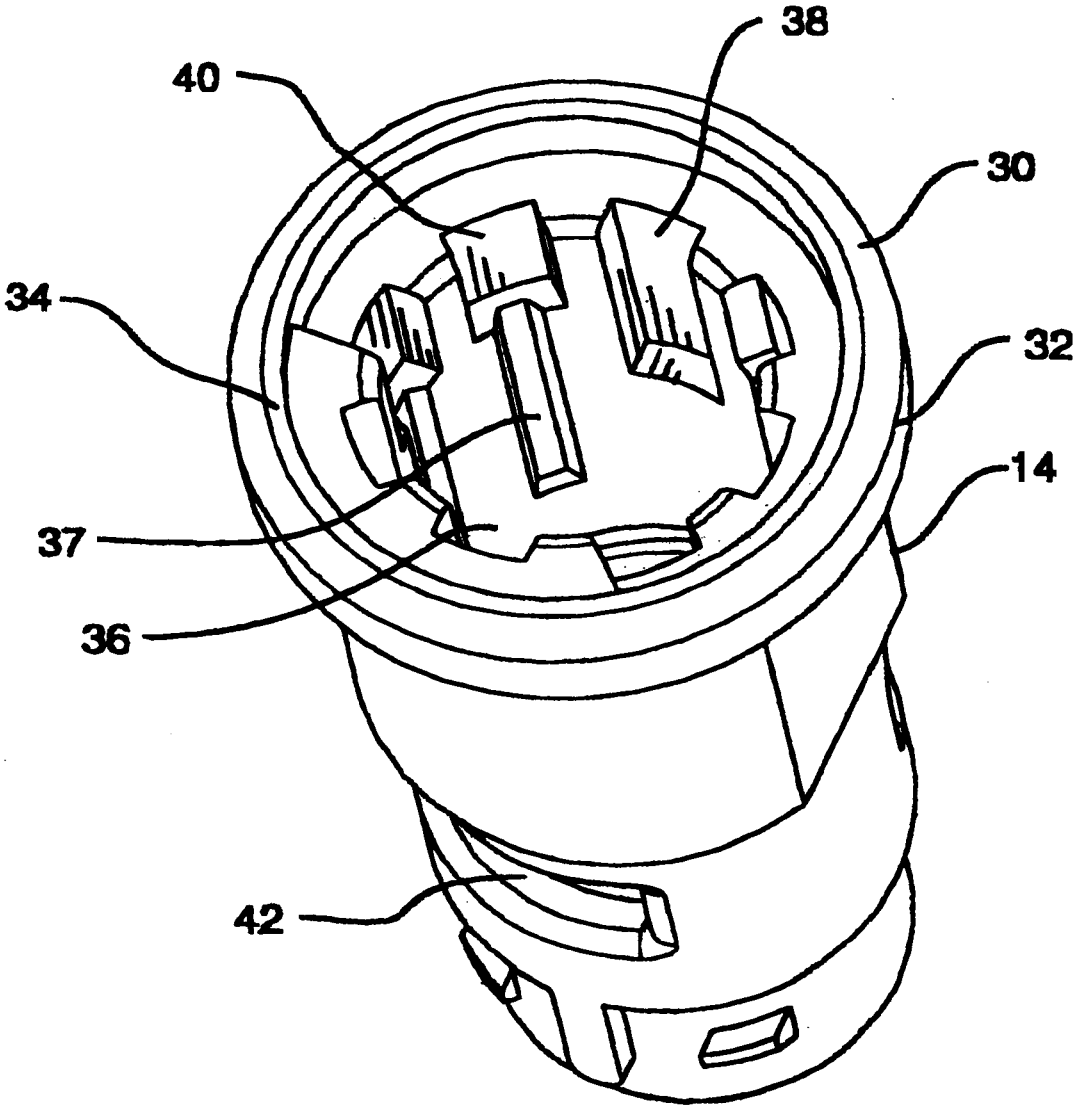
FIG. 5 is an enlarged perspective view of the shell portion of the switchlock assembly of FIG. 2.
Figure 6:
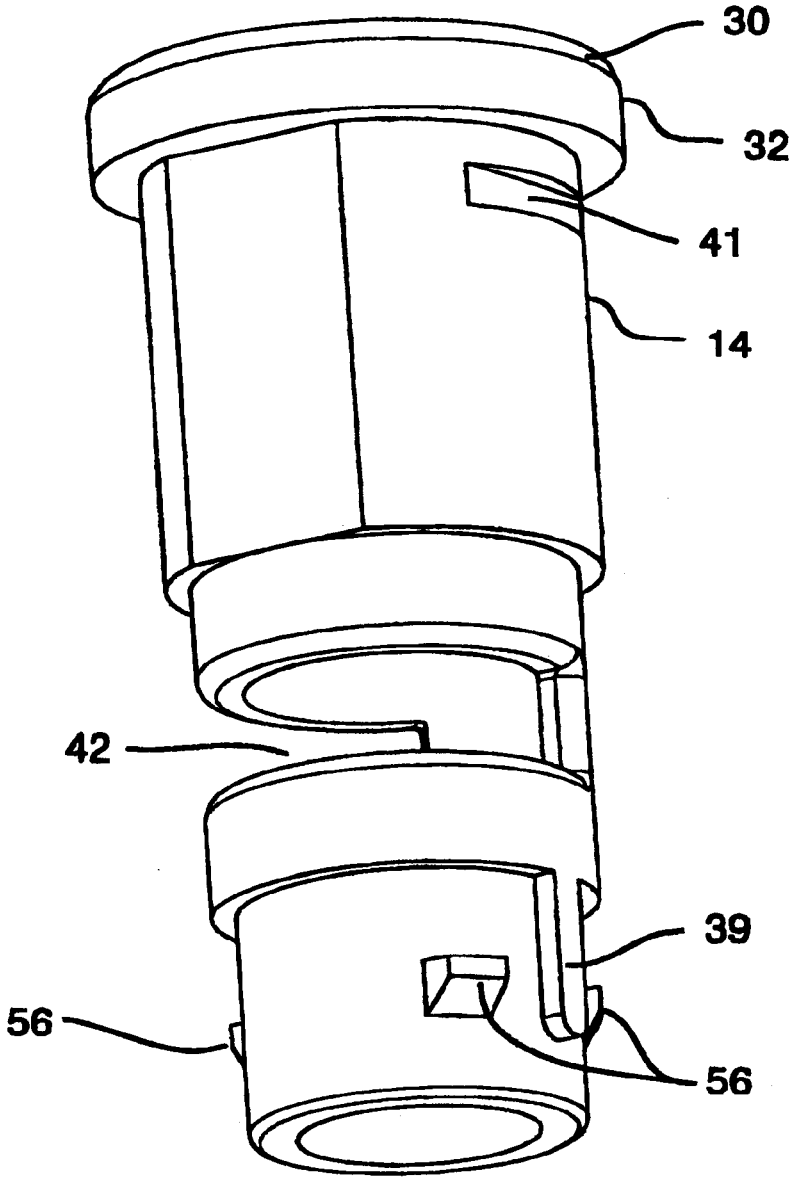
FIG. 6 is an enlarged, perspective view of the shell portion of the switchlock assembly showing a circumferential opening to accommodate cam rotation.

Referring to FIG. 2, FIG. 5, and FIG. 6, FIG. 5 and FIG. 6 are enlarged perspective views of the shell 14. The shell 14 is a one piece shell having a head 30 with a flange 32. There is a cylindrical recess 34 to accommodate a head 17 of plug 16 so that the face of the plug 16 is flush with the face of the shell 14. The shell 14 has a cylindrical bore 36 extending therethrough to accommodate the body of the plug 16. Near the top of the cylindrical bore 36 are a variety of different splines 38, 40, for accommodating the various switch functions.

FIG. 6 shows a cam slot 42 for receiving the cam 18. A longitudinal guide 39 is provided on the lower outside portion of the shell 14 for guiding the shell 14 into the switch base 12. Three tabs 56 protrude from and are spaced apart around the lower circumference of the shell 14 for securing the shell 14 in the switch base 12.

Figure 3:
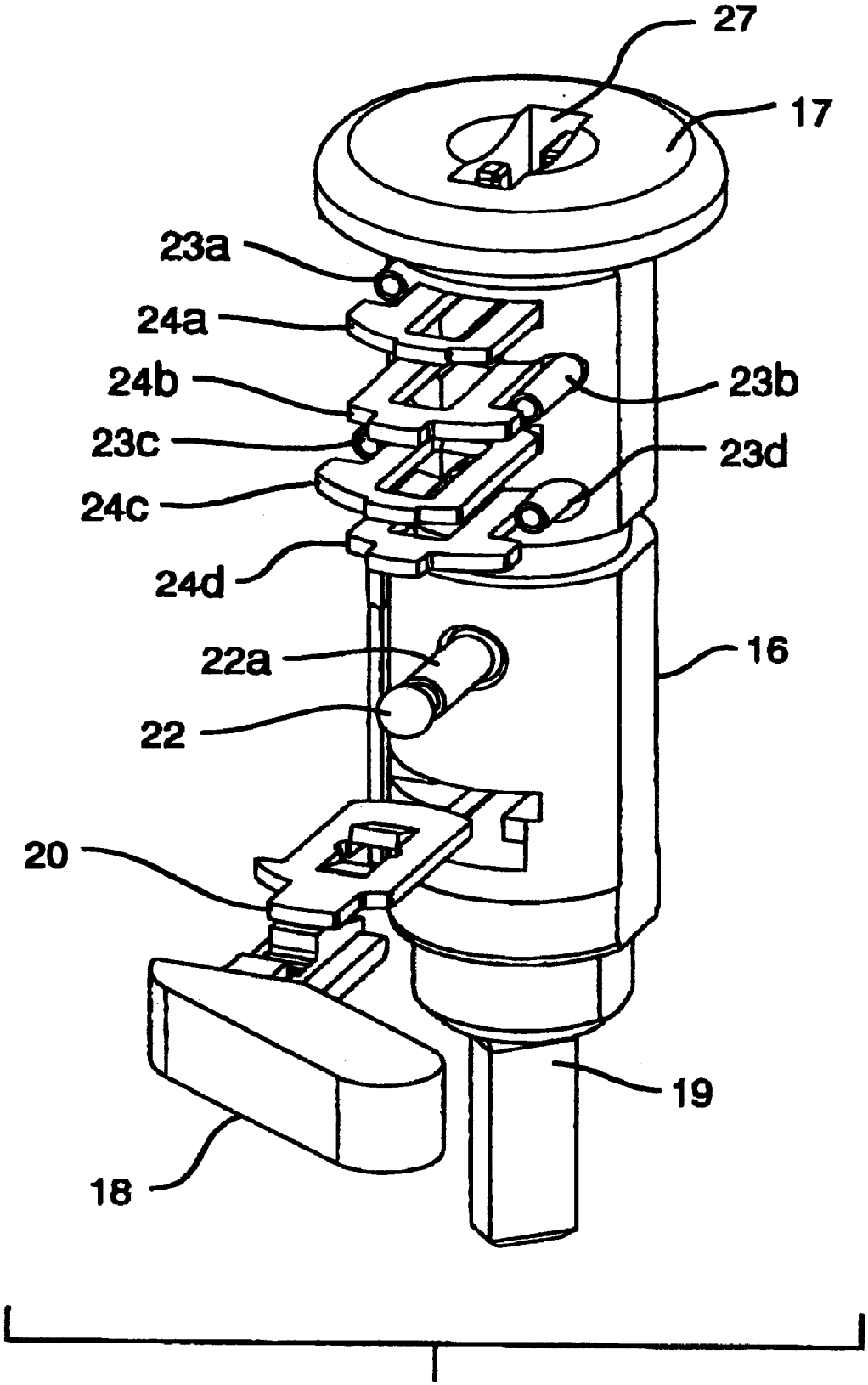
FIG. 3 is an enlarged, exploded, perspective view of the plug portion of the switchlock assembly of FIG. 2.
Figure 4:
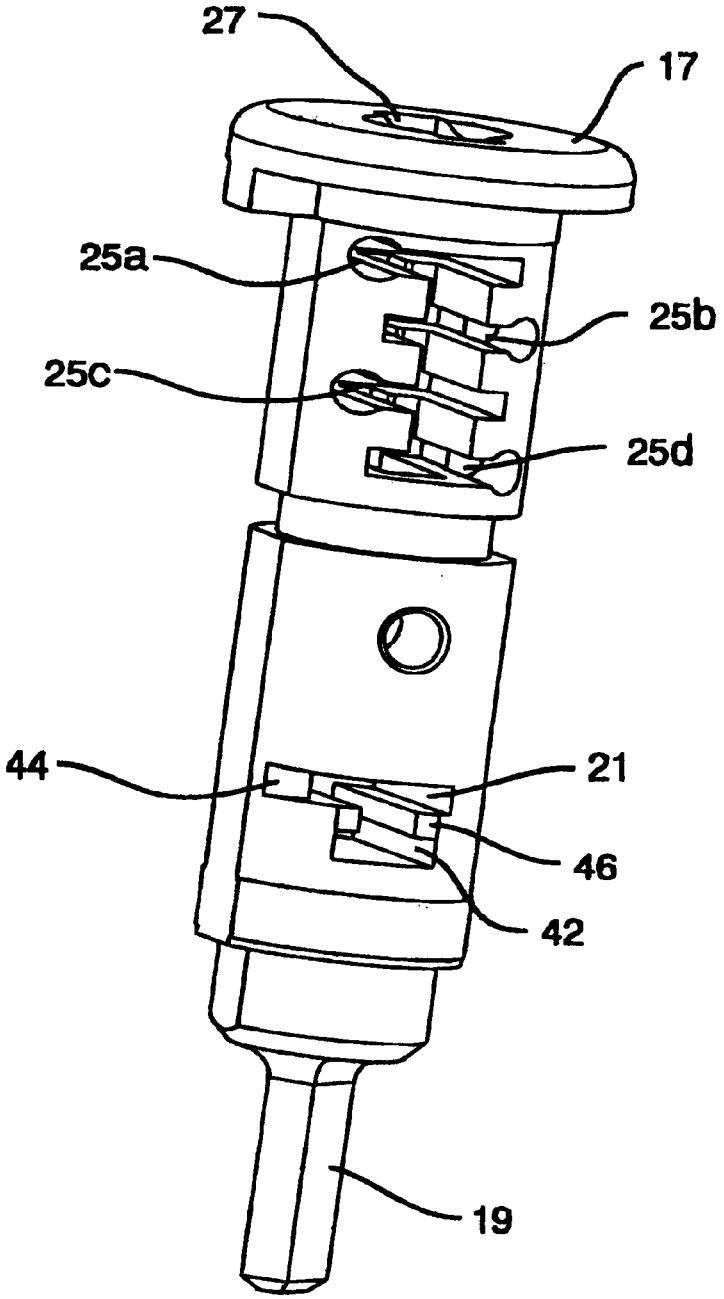
FIG. 4 is an enlarged perspective view of the plug portion of the switchlock assembly of FIG. 2 with tumblers, cam and latch clip removed.

Referring to FIG. 2, FIG. 3 and FIG. 4, FIG. 3 is an enlarged exploded, perspective view of the plug 16 and FIG. 4 is an enlarged perspective view of the plug 16 showing tumbler slots 25*a*–25*d* for receiving tumblers 24*a*–24*d* and cam slot 42 for receiving cam 18. The plug 16 has a generally cylindrical body with a key slot 27 on the top surface of the head 17. Extending from the bottom of the plug 16 is a switch driver 19 which fits into a switch actuator slot 13 in the switch base 12. When the key 26 causes the switch driver 19 to turn, the actuator in the switch base 12 rotates resulting in an electrical switch action between electrical terminals (not shown) extending from the switch base 12.

Figure 7:
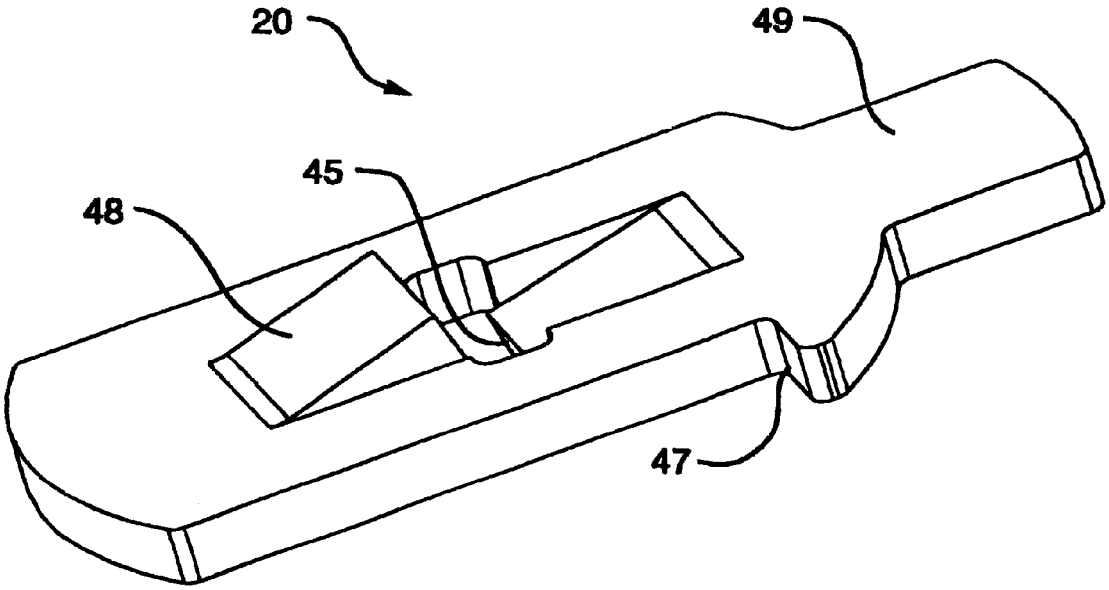
FIG. 7 is an enlarged perspective view of the latch clip.
Figure 8:
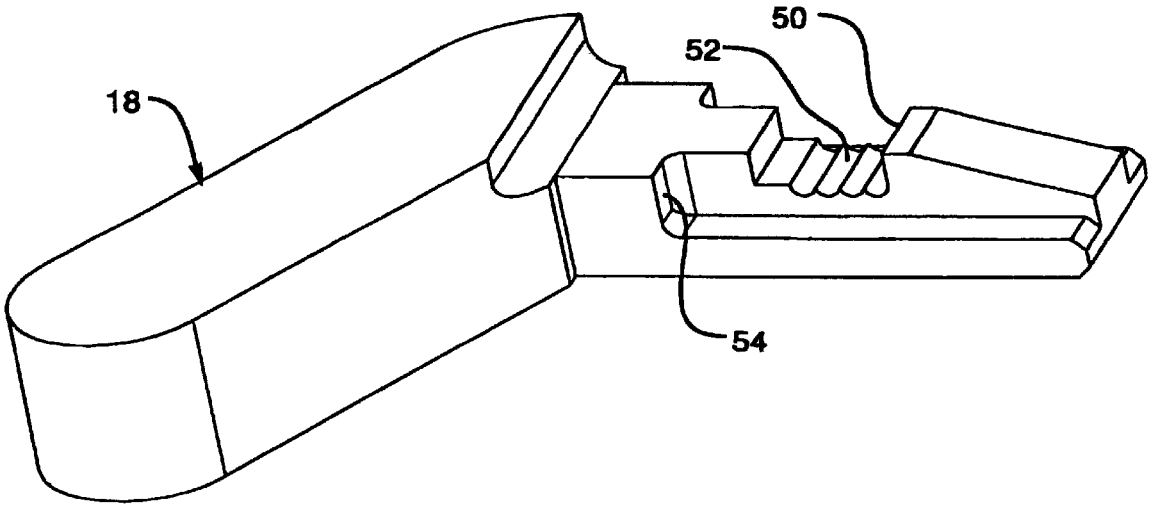
FIG. 8 is an enlarged perspective view of the cam.
Figure 9:
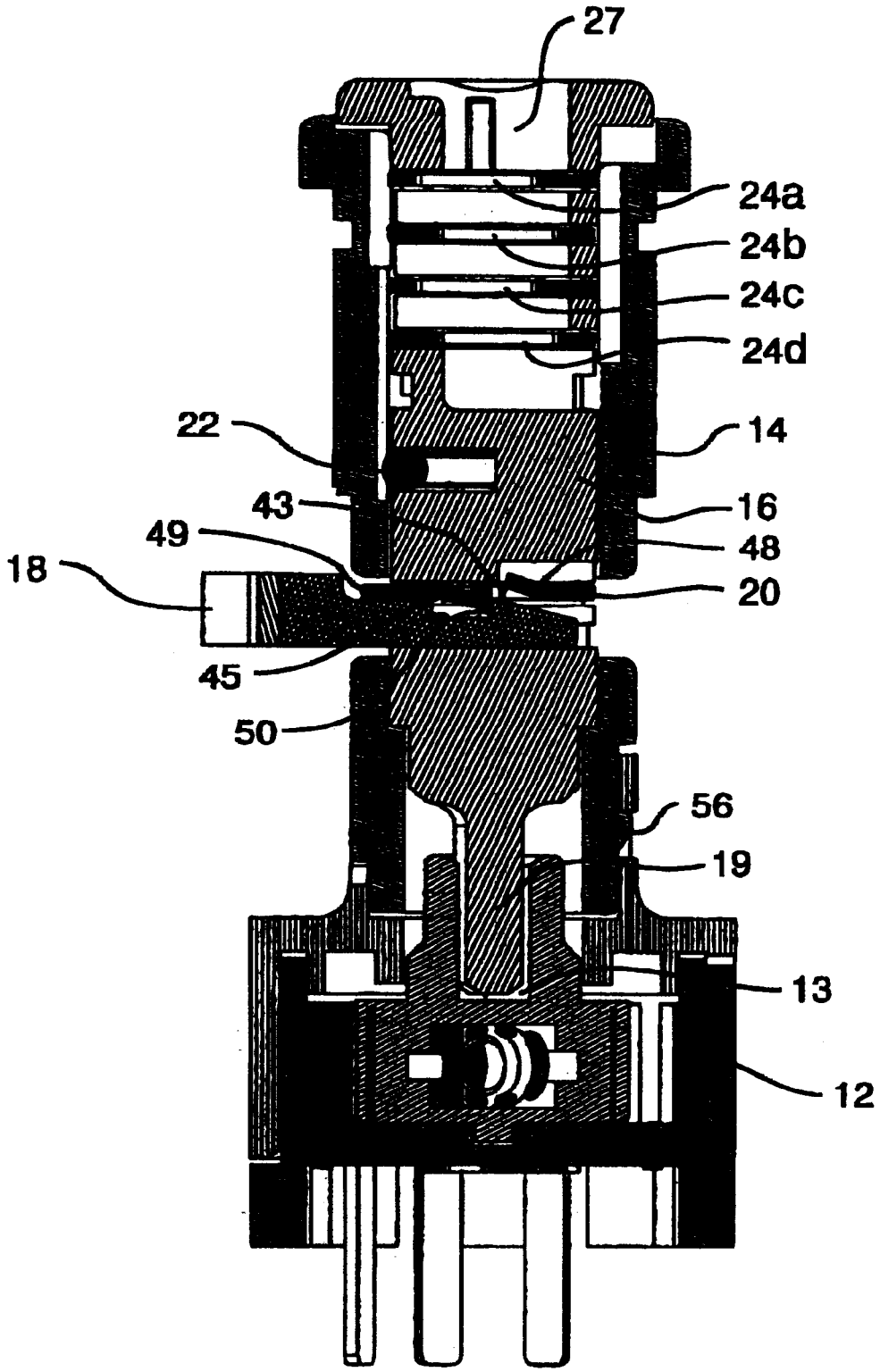
FIG. 9 is a cross-sectional view of the switchlock assembly of FIG. 1 showing a latch clip retention tab locked into the plug and the cam locked into the plug by a latch clip retraction tab.
Figure 10:
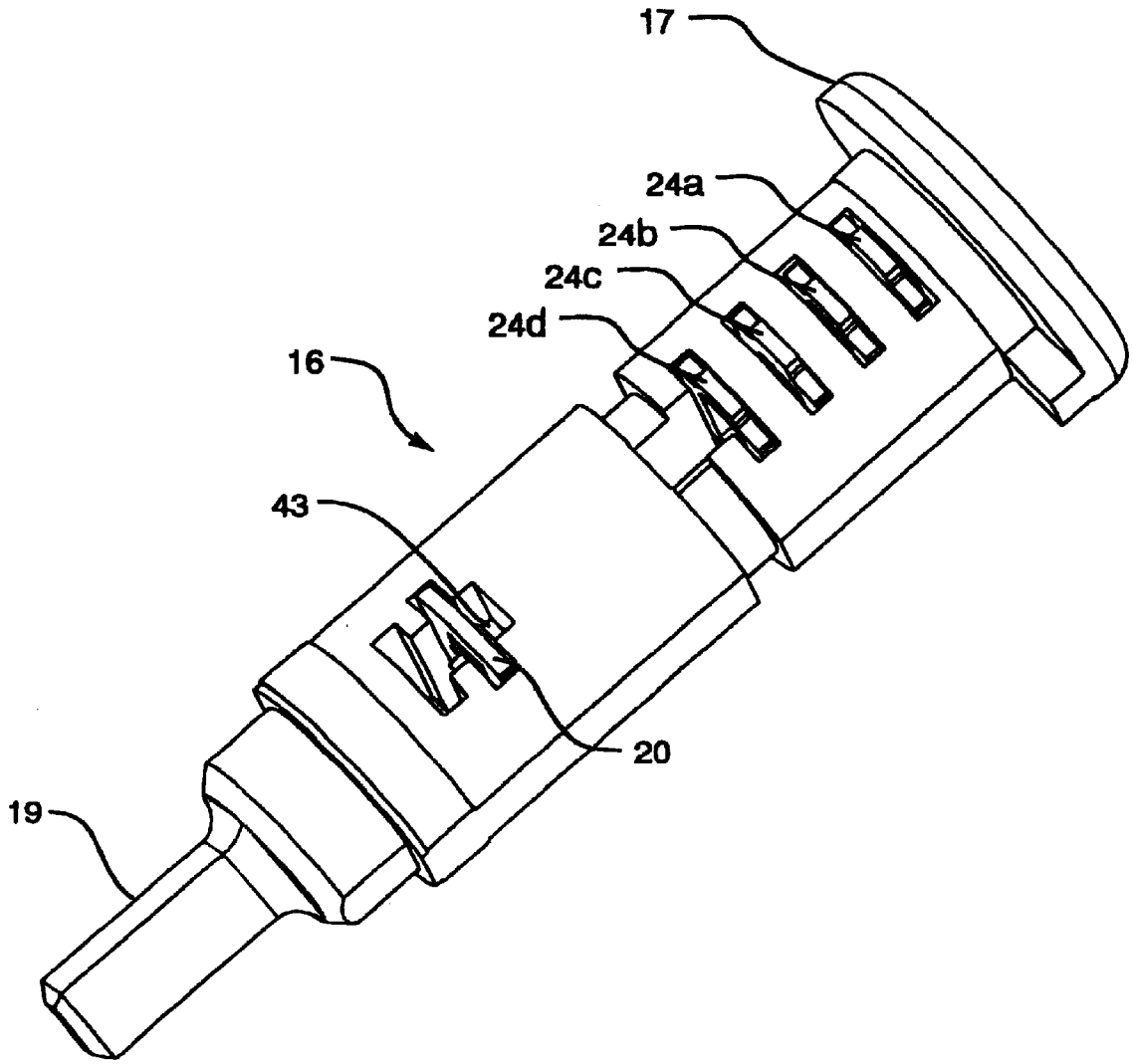
FIG. 10 is an enlarged perspective view of the plug portion of the switchlock assembly rotated 180 degrees from the view of FIG. 3.
Figure 11:
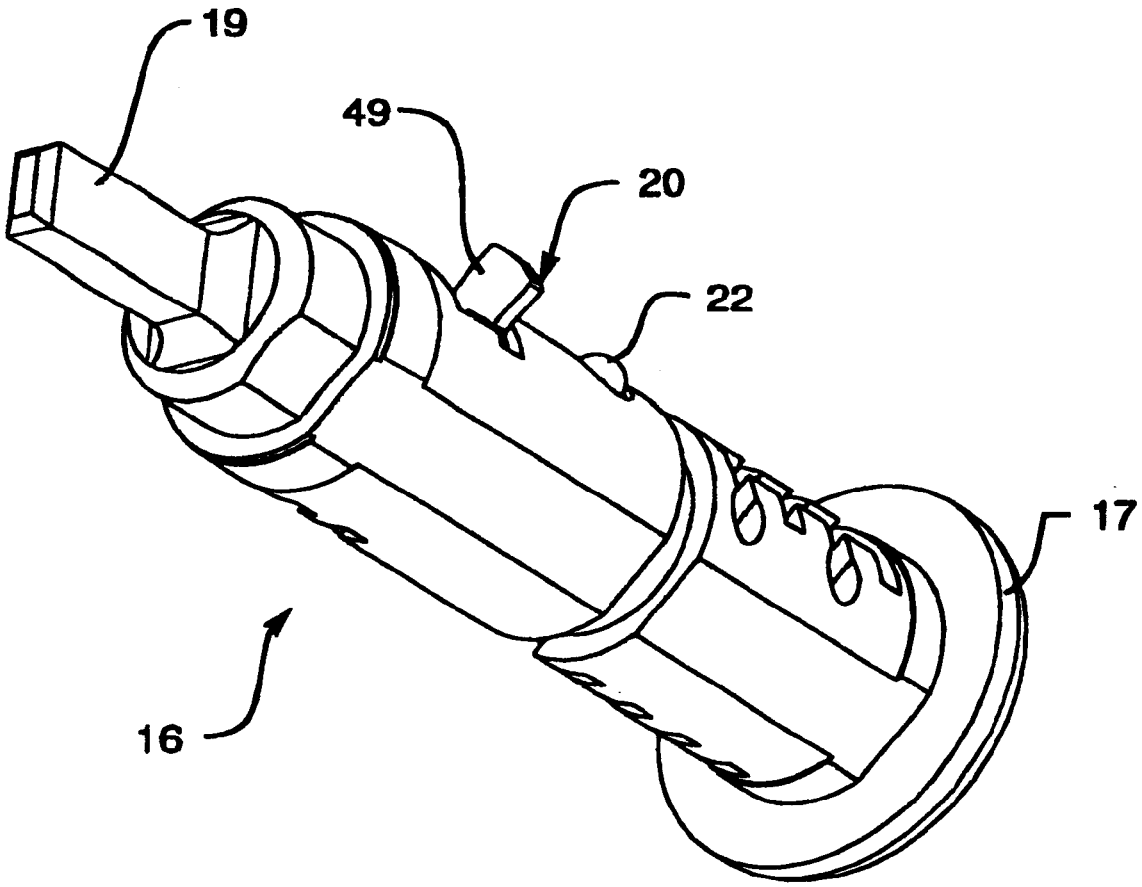
FIG. 11 is an enlarged perspective view of the plug portion of the switchlock assembly positioned to show a retention end of the latch clip extending beyond the diameter of the shell.

Referring to FIGS. 2–4 and 7–11, FIG. 7 is an enlarged perspective view of the latch clip 20 and FIG. 8 is an enlarged perspective view of the cam 18. FIG. 9 is a cross-sectional view of the switchlock assembly 10 showing the latch clip retention tab 48 locked into the plug 16 and the cam 18 locked into the plug 16 by a latch clip retraction tab 45. FIG. 10 is an enlarged perspective view of the plug 16 portion of the switchlock assembly 10 rotated approximately 180 degrees from the view of FIG. 3 and FIG. 11 shows a retention end 49 of the latch clip 20 extending beyond the diameter of the plug 16. The tumblers 24*a*–24*d*, tumbler springs (23*a*–23*d*), a detent spring 22*a*, a detent ball 22 and a latch clip 20 are inserted into plug 16. The key 26 is inserted into the plug 16 to retract the tumblers 24*a*–24*d* positioned in slots 24*a*–25*d*, and the plug 16 may then be inserted into the shell 14. The latch clip 20 shown in FIG. 7 is inserted into a latch clip slot 21 (FIG. 4) above a cam slot 42 until the latch clip 20 insertion stop 47 mates with a first plug surface A 44. The latch clip 20 with retention tab 48 snaps into a plug surface 43 as shown in FIG. 9 which secures the latch clip 20 in both directions and prevents the latch clip 20 from being removed. A retention end 49 of the latch clip 20, as shown in FIG. 11, extends out beyond the diameter of the plug 16 to the diameter of the shell 14. This prevents the plug 16 from being removed from the shell 14, and the latch clip 20 is free to rotate with the plug 16.

Referring to FIG. 4, FIG. 7 and FIG. 8, the cam 18 is inserted through the shell cam slot 42 as shown in FIG. 4 until the cam insertion stop 54 mates with the plug surface B, 46. When the cam 18 is inserted to that depth, the cam retraction tab 45 on the latch clip 20, which is installed in the plug 16, snaps into the cam latch clip slot 52 and is retained by the cam retraction stop 50 as shown in FIGS. 8 and 9. This connection prevents the cam 18 from being removed, but allows the cam 18 to freely rotate with the plug 16. The latch clip 20 may be embodied by brass material, and the cam 18 may be embodied by zinc die cast material in the preferred embodiment.

Referring to FIG. 1, FIG. 2, FIG. 6 and FIG. 9, switchlock assembly 10 is mounted to a panel (not shown) from the front of the panel, and secured to the panel by a spring clip (not shown) which fits in spring clip grooves 41 shown in FIGS. 1 and 6. Then the cam 18 is inserted into the plug 16 and retained by the latch clip 20. The shell 14 snaps into the switch base 12 and the switch driver 19 extending from the lower end of the plug 16 is inserted into the switch actuator slot 13 in the switch base 12. As the plug 16 is rotated, the cam 18 rotates and the switch driver 19 forces the internal contacts of the switch base 12 to rotate with the plug 16, thereby providing electrical switching to occur.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A switchlock assembly for mounting in a panel comprising:

a cylindrical shell having a circumferential opening in a side of said shell;

a lock plug positioned within said cylindrical shell having a keyway entering at a first end and a switch driver extending axially from a second end of said lock plug;

a switch base mounted on an end of said shell having an opening for receiving said switch driver from said second end of said lock plug;

a latch clip inserted within said circumferential opening of said shell and into a clip slot on a side of said lock plug for securing said latch clip within said lock plug; and a cam, having a first portion inserted into said circumferential opening in said side of said shell, snaps into said lock plug adjacent to said latch clip, a second portion of said cam extending outside the diameter of said switch lock assembly, said cam freely rotating with said plug.

2. The switchlock assembly as recited in claim 1 wherein said lock plug rotates in accordance with a turning of a key inserted into said keyway, thereby rotating said cam.

3. The switchlock assembly as recited in claim 1 wherein said cylindrical shell comprises a flanged head at an outer end, said flange being recessed to receive a head portion of said plug whereby a face of said plug is flush with a face of said shell.

4. The switchlock assembly as recited in claim 1 wherein said lock plug comprises a plurality of tumbler slots for receiving a plurality of tumblers operated by a key inserted in said keyway.

5. The switchlock assembly as recited in claim 1 wherein said clip slot in the side of said cylindrical plug comprises means for securing a retention tab of said latch clip to prevent removal of said latch clip from said plug.

6. The switchlock assembly as recited in claim 1 wherein said latch clip inserted in said switchlock assembly extends outwardly to at least the outside diameter of said shell thereby preventing said plug from being removed from said shell.

7. The switchlock assembly as recited in claim 1 wherein said first portion of said cam comprises a slot for receiving a cam retraction tab of said adjacent latch clip thereby preventing said cam from being removed from said switchlock assembly.

8. The switchlock assembly as recited in claim 1 wherein said latch clip comprises a first retention tab extending at an acute angle in a first direction and a second retraction tab extending at an acute angle in a second direction opposite said first direction, said first retention tab snapping into an internal surface of said plug for securing said latch clip within said plug.

9. The switchlock assembly as recited in claim 1 wherein said latch clip retains said lock plug within said shell and said latch clip retains said cam within said lock plug.

10. A switchlock assembly adapted for mounting through an opening in a panel from outside said panel comprising:

a plug having a key slot in a first end for receiving a key, a switch driver extending from a second end and a plurality of tumbler slots arranged on a cylindrical wall of said plug having a tumbler inserted in each of said slots;

a shell having a cylindrical bore extending therethrough for receiving said plug, said shell having a slot around a portion of the circumference of said shell;

a switch base attached to an end of said shell and operated by turning said plug with said key;

a latch clip having a first retention tab extending at an acute angle in a first direction and a second retraction tab extending at an acute angle in a second opposite direction, said latch clip being inserted through said circumferential slot of said shell and into a latch clip slot on the side of said plug, said first retention tab snapping into an internal surface of said plug thereby securing said latch clip within said plug; and a cam having a latch portion extending through said circumferential slot in the side of said shell into said plug adjacent to said latch clip wherein said second retraction tab of said latch clip snaps into a slot of said latch portion of said cam, thereby securing said cam inside said plug.

11. The switchlock assembly as recited in claim 10 wherein said switchlock assembly comprises means for enabling said shell to be mounted in said panel opening.

12. The switchlock assembly as recited in claim 10 wherein said switch base comprises an actuator slot for receiving said switch driver extending from said plug.

13. The switchlock assembly as recited in claim 10 wherein said shell comprises an outer end having a head with a flange and a cylindrical recess for accommodating a head of said plug wherein a face of said plug is flush with a face of said shell.

14. The switchlock assembly as recited in claim 10 wherein said tumblers and tumbler splines control the removal of said key from a designated position.

15. The switchlock assembly as recited in claim 10 wherein said latch clip comprises a retention end extending beyond the diameter of said plug and the inside diameter of said shell to prevent said plug from being removed from said shell.

16. The switchlock assembly as recited in claim 10 wherein said latch clip retains said plug within said shell and said latch clip retains said cam within said plug.

17. A method of providing a switchlock assembly having a snap-in cam comprising the steps of:

providing a cylindrical shell having a circumferential opening in a side of said shell;

positioning a lock plug within said cylindrical shell, said lock plug having a keyway entering at a first end and a switch driver extending axially at a second end of said lock plug;

mounting a switch base on an end of said shell having an opening for receiving said switch driver extending axially from said second end of said lock plug;

inserting a latch clip into said circumferential opening of said shell and into a clip slot on a side of said lock plug to secure said latch clip within said lock plug; and inserting a first portion of a cam into said circumferential opening in said side of said shell and into said lock plug, said cam snapping into said lock plug, and a second portion of said cam extending outside the diameter of said switchlock assembly.

18. The method as recited in claim 17 wherein said method comprises the step of inserting a key into said keyway of said lock plug for rotating said cam.

19. The method as recited in claim 18 wherein said step of inserting a key into said keyway comprises the step of providing a plurality of tumblers within said lock plug operated by said key.

20. The method as recited in claim 17 wherein said step of inserting said latch clip into said circumferential opening of said shell and into a clip slot on a side of said lock plug comprises the step of extending an end of said latch clip to at least the outside diameter of said shell thereby preventing said plug from being removed from said shell.

21. The method as recited in claim 17 wherein said step of inserting said latch clip comprises the step of extending a first retention tab of said latch clip at an acute angle in a first direction and extending a second retraction tab of said latch clip at an acute angle in a second direction opposite said first direction, whereby said first retention tab snaps against an internal surface of said plug securing said latch clip within said lock plug.

22. The method as recited in claim 21 wherein said step of inserting said latch clip into said circumferential opening in said side of said shell and into said lock plug comprises the step of snapping said second retraction tab of said latch clip into a slot of said cam for retaining said cam within said switchlock assembly.

23. The method as recited in claim 17 wherein said step of inserting said latch clip into said plug provides for retaining said plug within said shell and retaining said cam within said plug.

* * * * *